US005629139A

United States Patent [19]

Twist

[11] Patent Number: 5,629,139

[45] Date of Patent: May 13, 1997

[54] PHOTOGRAPHIC PROCESSING SOLUTION COMPOSITION

[75] Inventor: Peter J. Twist, Gt. Missenden, United Kingdom

[73] Assignee: Eastman Kodak Company, Rochester, N.Y.

[21] Appl. No.: 538,760

[22] Filed: Oct. 3, 1995

[30] Foreign Application Priority Data

Oct. 4, 1994 [GB] United Kingdom ..... 9419978

[51] Int. Cl.[6] ..... G03C 5/42; G03C 5/44; G03C 5/18; G03C 5/26

[52] U.S. Cl. ..... 430/461; 430/373; 430/393; 430/414; 430/430; 430/490; 430/491; 430/493; 430/936; 430/943

[58] Field of Search ..... 430/372, 373, 430/393, 414, 430, 461, 488, 490, 491, 493, 936, 943

[56] References Cited

U.S. PATENT DOCUMENTS

| | | | |
|---|---|---|---|
| 3,841,873 | 10/1974 | Mowrey et al. | 96/22 |
| 4,069,050 | 1/1978 | Hara et al. | 430/373 |
| 4,089,685 | 5/1978 | Bissonette | 96/22 |
| 4,277,556 | 7/1981 | Koboshi et al. | 430/943 |
| 4,301,236 | 11/1981 | Idota et al. | 430/393 |
| 4,414,305 | 11/1983 | Nakamura et al. | 430/373 |
| 4,880,725 | 11/1989 | Hirai et al. | 430/373 |
| 5,380,627 | 1/1995 | Grimsey | 430/943 |
| 5,387,499 | 2/1995 | Earle et al. | 430/373 |

FOREIGN PATENT DOCUMENTS

| | | | |
|---|---|---|---|
| 1-116544 | 5/1989 | Japan | 430/430 |
| WO93/11460 | 6/1993 | WIPO | 430/490 |

*Primary Examiner*—Glenn A. Caldarola
*Assistant Examiner*—J. Pasterczyk
*Attorney, Agent, or Firm*—J. Lanny Tucker

[57] ABSTRACT

Photographic elements, especially color papers, can be processed with developer, redox amplification or bleaching solutions that contain hydrogen peroxide or other oxidants. These solutions include a dissolved compound that has a hydrophobic hydrocarbon group and an additional group that enables the compound to adsorb to silver or stainless steel. The dissolved compound inhibits the catalytic effect of the metal on decomposition of the hydrogen peroxide so the processing solutions are more stable.

18 Claims, No Drawings

PHOTOGRAPHIC PROCESSING SOLUTION COMPOSITION

FIELD OF THE INVENTION

This invention relates to photographic processing solutions and in particular to photographic processing solutions containing hydrogen peroxide. It also relates to a method of using these processing solutions.

BACKGROUND OF THE INVENTION

Redox amplification processes have been described, for example in British Specification Nos. 1,268,126, 1,399,481, 1,403,418 and 1,560,572. In such processes color materials are developed to produce a silver image (which may contain only small amounts of silver) and then treated with a redox amplifying solution (or a combined developer-amplifier) to form a dye image.

The developer-amplifier solution contains a color developing agent and an oxidizing agent that will oxidize the color developing agent in the presence of the silver image which acts as a catalyst. An amplifier solution contains the oxidant but for its dye image forming depends on color developer carried over from the previous developer bath.

Oxidized color developer reacts with a color coupler to form the image dye. The amount of dye formed depends on the time of treatment or the availability of color coupler and is less dependent on the amount of silver in the image as is the case in conventional color development processes.

The stability of amplifier and developer/amplifier solutions is not good while that of bleach solutions can cause problems, though not to the same extent.

A number of ways of stabilizing amplifier and developer/amplifier solutions have been proposed in the art.

We have now found that the stability of a replenished amplifier, developer/amplifier, or bleach bath deteriorates as processing progresses (or as the solution is seasoned). It has now been discovered that this instability is apparently caused by silver deposited in the tank and pipework or other metallic parts of the machine. The present invention seeks to solve this problem.

SUMMARY OF THE INVENTION

This invention provides a photographic processing solution comprising a redox amplification oxidant or a compound that provides a redox amplification oxidant, and dissolved therein, a compound having a hydrophobic hydrocarbon group and a group which adsorbs to silver or stainless steel.

This invention also provides a method for processing an imagewise exposed silver halide photographic element comprising contacting the element with the photographic processing solution just described.

It is believed that the compound that adsorbs to silver inhibits the silver's catalytic effect.

An RX amplifier or developer/amplifier can be run in a continuous processor in which silver deposits would otherwise occur and still be as stable as in the absence of silver deposits.

The long chain amines, in particular, have very little sensitometric effect on the material at 0.1 g/l or even at 5 times this level.

The most likely catalytic agents are silver metal or stainless steel. Such materials might be found generally inside the tanks and pipework or may be localized metal parts exposed to the processing solution.

The materials used in the present invention could be used to stabilize peroxide solutions used as silver bleaches which tend to decompose in the presence of metals.

DETAILED DESCRIPTION OF THE INVENTION

The photographic processing solution may be a developer/amplifier, amplifier or bleach solution.

The redox amplification oxidant may be a persulphate, periodate, Cobalt(III) compound or, preferably, hydrogen peroxide, or a compound providing any of them.

In the compound described above, the hydrophobic hydrocarbon group preferably comprises a long chain alkyl group that may be branched or unbranched and may be an alkyl group having from 8 to 20 carbon atoms, more preferably from 10 to 18 and particularly from 10 to 16 carbon atoms. Alternatively the compounds may comprise more than one alkyl group, the sum of their carbon atoms being from 8 to 20 or an alkylaryl group having from 14 to 27 carbon atoms in total.

It is believed that the main purpose of the hydrophobic hydrocarbon group is to ensure that the compound is not able to diffuse into the photographic material where it could affect sensitometric properties, and to make the silver and other metal surfaces hydrophobic.

Compounds that adsorb to silver are preferably primary, secondary or tertiary long chain alkylamines, long chain alkyl quaternary ammonium salts, long chain alkyl heterocyclic ammonium salts, long chain alkyl aminocarboxylic acids, long chain alkyl aminosulphonic acids, long chain alkyl diamines, long chain alkyl branched alkyldiamines, long chain alkyl thiols, long chain alkyl thiocarboxylic acids, long chain alkyl thiosulphonic acids, long chain alkyl-substituted nitrogen-containing heterocyclic or mercaptoheterocyclic compounds, for example long chain alkyl substituted benzotriazoles, 1-phenyl-5-mercaptotetrazoles and 5-nitroindazoles in which the long chain alkyl group contains 7–20 carbon atoms.

Examples of such compounds are shown in the following table:

TABLE 1

| Compound | General formula | n |
|---|---|---|
| Alkyl amines | $NH_2(CH_2)_nCH_3$ | 7–17 |
| Alkylaryl amines | 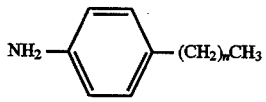 | 1–11 |

TABLE 1-continued

| Compound | General formula | n |
|---|---|---|
| Secondary and tertiary alkyl amines | $NR_1R_2(CH_2)_nCH_3$ | 7–17 |
| Alkyl quaternary salts | $\overset{+}{R}NH_2(CH_2)_nCH_3$ | 7–17 |
| Alkyl heterocyclic quaternary salts | 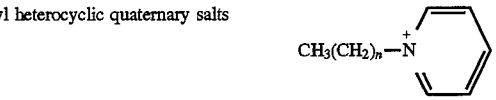 | 1–15 |
| Alkyl amino carboxylic acids | $NH_2(CH_2)_nCOOH$ | 7–20 |
| Alkyl amino sulphonic acids | $NH_2(CH_2)_nSO_3H$ | 7–20 |
| Alkyl diamines | $NH_2(CH_2)_nNH_2$ | 8–20 |
| Branched alkyl diamines | $NH_2CH(NH_2)-(CH2)_nCH_3$ | 6–20 |
| Alkyl thiols | $SH-(CH_2)_nCH_3$ | 7–17 |
| Alkyl thiocarboxylic acids | $SH-(CH_2)_nCOOH$ | 7–20 |
| Alkyl thiosulphonic acids | $SH-(CH_2)_nSO_3H$ | 7–20 |

Further examples of heterocyclic compounds which adsorb to silver are: oxazoles, thiazoles, diazoles, triazoles, oxadiazoles, thiadiazoles, oxathiazoles, thiatriazoles, tetrazoles, benzimidazoles, indazoles, isoindazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles and benzisodiazoles.

Specific examples of such compounds are dodecylamine, hexadecylamine, octadecylamine, dodecylammonium acetate, tetradecylammonium hydrochloride, tetradecylbenzotriazole, 1-(4-dodecylphenyl)-3-mercaptotetrazole and tetradecyl-5-nitroindazoles, and mixtures thereof.

The amount of the compound needed to deactivate silver deposits is small, for example from 0.01 to 5 g/l, preferably from 0.05 to 1 g/l, and more preferably from 0.1 to 0.5 g/l.

When the compound does not readily dissolve in the processing solution, the solution may also contain a non-ionic surfactant. Examples of suitable non-ionic surfactants are polyoxyethylene long chain esters, alcohols, and amines and the number of polyoxyethylene groups is from 3 to 30. The compounds listed in Table 2 may be used for this purpose. Preferably, the non-ionic surfactant is a polyoxyethylene ester having an alkyl group of 8 to 20 carbon atoms.

TABLE 2

| Name of surfactant | Description |
|---|---|
| TWEEN ™ 80 | Polyoxyethylene sorbitan monooleate |
| TWEEN ™ 20 | Polyoxyethylene sorbitan monolaurate |
| TRITON ™ X-100 | Iso octyl phenoxypolyethoxyethanol |
| DOWFAX ™ 9N10 | Nonyl phenol ethoxylate |
| DOWFAX ™ 9N5 | Nonyl phenol ethoxylate |
| SYNPERONIC ™ OP8 | Octyl phenol ethoxylate |
| ETHOMEEN ™ S25 | Polyoxyethylene oleylamine |
| ETHOMEEN ™ T25 | Polyoxyethylene tallow-amine |

The nonionic surfactants may be used in amounts of 0.01 to 10 g/l, and preferably in the amount needed to solubilize the compound having the hydrophobic hydrocarbon group.

The preferred color developing agents are:

4-amino-3-methyl-N,N-diethylaniline hydrochloride, 4-amino-3-methyl-N-ethyl-N-β-(methanesulphonamido)-ethylaniline sulphate hydrate, 4-amino-3-methyl-N-ethyl-N-β-hydroxyethylaniline sulphate, 4-amino-3-β-(methanesulphonamido)ethyl-N,N-diethylaniline hydrochloride, and 4-amino-N-ethyl-N-(2-methoxy-ethyl)-m-toluidine di-p-toluene sulphonate.

Peroxide-containing bleach solutions are described in European Publications 0 540 619, 0 569 576 and 0 506 909.

Examples of suitable peroxide oxidizing agents are peroxy compounds including hydrogen peroxide and compounds that provide hydrogen peroxide, e.g., addition compounds of hydrogen peroxide.

Other components that may be included in a developer/amplifier solution include a base, e.g., potassium or sodium hydroxide; a pH buffer such as a carbonate, borate, silicate or phosphate; antioxidants such as hydroxylamine sulphate, diethylhydroxylamine and substituted alkylhydroxylamines as described, for example in U.S. Pat. Nos. 4,876,174 and 5,354,646; metal-chelating compounds such as 1-hydroxyethylidene-1,1'-diphosphonic acid, catechol disulphonate and diethyltriamine-pentaacetic acid. Other components may be present, for example those mentioned in Research Disclosure Item 308119, December 1989 published by Kenneth Mason Publications, Emsworth, Hants, United Kingdom.

A particular application of this invention is in the processing of silver chloride color paper, for example paper comprising at least 85 mole percent silver chloride, especially such paper having total silver levels from 5 to 700 $mg/m^2$, and for image amplification applications levels from 10 to 120 $mg/m^2$, particularly from 15 to 60 $mg/m^2$.

Such color materials can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

While the present solutions may be used in conventional large scale or minilab processing environments the present processing solutions are preferably used in a method of processing carried out by passing the material to be processed through a tank containing the processing solution that is recirculated through the tank at a rate of from 0.1 to 10 tank volumes per minute.

The preferred recirculation rate is from 0.5 to 8, especially from 1 to 5 and particular from 2 to 4 tank volumes per minute.

The recirculation, with or without replenishment, is carried out continuously or intermittently. In one method of working both could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence in a preferred embodiment of the present invention the ratio of tank volume to maximum area of material accomodatable therein (i.e., maximum path length× width of material) is less than 11 $dm^3/m^2$, preferably less than 3 $dm^3/m^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 2 mm. The shape of the tank is not critical but it could be in the shape of a shallow tray or, preferably U-shaped (that is, having a rack and tank design). It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leqq F/A \leqq 23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material. Such Low Volume Thin Tank systems are described in more detail in the following publications: U.S. Pat. No. 5,294,956, EP 559,027, U.S. Pat. No. 5,179,404, EP 559,025, U.S. Pat. No. 5,270,762, EP 559,026, WO 92/10790, WO 92/17819, WO 93/04404, WO 92/17370, WO 91/19226, WO 91/12567, WO 92/07302, WO 93/00612, WO 92/07301, WO 92/09932.

In the following discussion of suitable materials for use in the emulsions and elements of this invention, reference will be made to Research Disclosure, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

The following Examples are included for a better understanding of the invention.

EXAMPLE 1

In this example several materials were examined as inhibitors for the silver catalyzed decomposition of a redox developer/amplifier solution (Dev/Amp). The basic Dev/Amp used is shown in Table 1.

TABLE 1

| Base Developer/Amplifier Solution | |
|---|---|
| 1-Hydroxyethylidene-1,1'-diphosphonic acid (60% soln) | 0.6 g/l |
| Diethyltriamine-pentaacetic acid penta sodium salt (40% soln) | 2.0 ml/l |
| $K_2HPO_4.3H_2O$ | 40 g/l |
| KBr | 1.0 mg/l |
| KCl | 0.5 g/l |
| Catechol-3,5-disulphonate | 0.3 g/l |
| Hydroxylamine sulphate | 1.0 g/l |
| KOH (50%) | 10.0 ml/l |
| 4-N-ethyl-N-(β-methanesulphonamidoethyl)-o-toluidine sesquisulphate (CD3) | 4.5 g/l |
| $H_2O_2$ (30%) | 2.0 ml/l |
| pH | 11.4 |
| Temperature | 32° C. |
| Time | 45 seconds |

Nine Dev/Amps were made up with the basic composition as in Table 1 except that all the Dev/Amps had 7.3 mg/l of colloidal silver added to them to cause rapid decomposition and also some materials designed to inhibit the catalysis. The colloidal silver was diluted from a dispersion that contained 4.43% silver and 7.8% gelatin. This is normally referred to as Carey Lea Silver, or CLS. The composition of the Dev/Amps is shown in Table 2.

TABLE 2

| Developer/Amplifier Composition | |
|---|---|
| Dev/Amp Number | |
| 1 | composition in Table 1 + 7.3 mg/l Silver |
| 2 | as Dev/Amp 1 + 0.4 g/l ARQUAD ™ MC-50 |
| 3 | as Dev/Amp 2 + 0.4 g/l TWEEN ™ 80 |
| 4 | as Dev/Amp 1 + 0.4 g/l ARQUAD ™ 16-50 + 0.4 g/l TWEEN ™ 80 |
| 5 | as Dev/Amp 1 + 0.4 g/l ARQUAD ™ S-50 + 0.4 g/l TWEEN ™ 80 |
| 6 | as Dev/Amp 1 + 0.4 g/l TWEEN ™ 80 |
| 7 | as Dev/Amp 1 + 0.4 g/l VERSA ™ TL-73 |
| 8 | as Dev/Amp 1 + 0.4 g/l ARMAC ™ 12D + 0.4 g/l TWEEN ™ 80 |

The ARQUAD™ materials are quaternary amine hydrochlorides with 3 methyl groups and a long chain alkyl group which for MC-50 is mainly $C_{12}$, for 16–50 is mainly $C_{16}$, and for S-50 is mainly $C_{18}$. ARMAC™ 12D is 97% dodecylamine acetate and TWEEN™ 80 is polyoxyethylene sorbitan mono-oleate.

In all cases the silver was added as the last component and the changes in color of the Dev/Amp were monitored over a period of hours. It is known from previous experiments that a darkening of the color from an initial pale, through, light then dark to black indicates increasing degree of oxidation of the color developing agent (CD3). The result of the observations on the nine developer/amplifiers above is shown in Table 3.

TABLE 3

| Dev/Amp oxidation | | | | |
|---|---|---|---|---|
| | Time after silver addition | | | |
| Dev/Amp | 10 min | 30 min | 2 hr | 24 hr |
| 1 | dark → | | | black- |
| 2 | pale | pale | light | light |
| 3 | pale | pale | light | light |
| 4 | pale | light | dark | dark |
| 5 | pale | light | dark | dark |
| 6 | dark | black → | | |
| 7 | dark | black → | | |
| 8 | pale | pale | pale | light |

Clearly Dev/Amp 8 is the best followed by 2 and 3.

EXAMPLE 2

In this example the effect of dodecylamine on the catalytic activity of silver deposits in the Dev/Amp tank of a low volume thin tank processor having the solution between tank walls about 2 mm apart is demonstrated. The Dev/Amp tank was cleaned out with hydrochloric acid and the washed several times with water. The Dev/Amp tank was filled with the Dev/Amp shown in Table 1 and the chemical loss rates were measured by taking samples at various times and analyzing for hydroxylamine sulphate (HAS), hydrogen peroxide and CD3 levels. After the start run the processor was filled with fresh Dev/Amp, as in Table 1 and paper was processed for 6 tank turnovers (TTOs), this comprised run 1. The Dev/Amp was removed and a fresh Dev/Amp added as in Table 1 and the chemical loss rates were measured as before. The sequence was repeated for run 2 and run 3. The Dev/Amp used to measure the chemical loss rates after run 3 was discarded and a fresh Dev/Amp added as in Table 1 but with 0.1 g/l of dodecylamine (Aldrich 98%) and 0.2 g/l of TWEEN™ 80. The dodecylamine was dissolved in an equimolar amount of acetic acid and mixed with the TWEEN™ 80 before adding to the Dev/Amp. It can be seen from Table 4 that there is a progressive increase in the chemical loss rates with the extent of paper processing up to run 3. The inclusion of compounds dodecylamine and TWEEN™ 80 completely removes the catalytic effect of the paper processing and gives chemical loss rates almost the same as at the start.

TABLE 4

| Chemical Loss Rates in Processor | | | |
|---|---|---|---|
| | HAS (g/l/hr) | $H_2O_2$ (ml/l/hr) | CD3 (g/l/hr) |
| Start | 0.0247 | 0.027 | 0.01 |
| After run 1 | 0.0611 | 0.0575 | 0.016 |
| After run 2 | 0.125 | 0.207 | 0.021 |
| After run 3 | 0.202 | 0.418 | 0.034 |
| After run 3 plus dodecylamine and TWEEN ™ 80 | 0.0216 | 0.0222 | <0.01 |

EXAMPLE 3

In this example the effect of dodecylamine on the silver-catalyzed decomposition of a redox Dev/Amp is examined. Four Dev/Amps were prepared based on the one in Table 1 and these are as follows:

Dev/Amp 10 the same as in Table 1, this is the control Dev/Amp.

Dev/Amp 11 as Dev/Amp 10 but with 0.2 g/l TWEEN™ 80 and 0.1 g/l dodecylamine.

Dev/Amp 12 as Dev/Amp 11 but the dodecylamine was first dissolved in glacial acetic acid before adding to the Dev/Amp, this adds 0.03 g/l of glacial acetic acid to the Dev/Amp.

Dev/Amp 13 was as Dev/Amp 12 but with five times the level of TWEEN™ 80(1 g/l) and five times the level of dodecylamine (0.5 g/l) and acetic acid (0.15 g/l).

To each of these Dev/Amps 0.73 mg/l of colloidal silver known as Carey Lea silver (CLS) was added in order to accelerate the decomposition. The color of these Dev/Amps was monitored over time and it was apparent that Dev/Amp 10 (the control) darkened noticeably in 10 minutes and particularly after 4 hours. The other 3 Dev/Amps 11, 12 and 13 stayed pale straw color over this time.

Sensitometric strips of an experimental low silver color paper multilayer, total silver laydown 1 118 mg/m$^2$ (11.0 mg/sq.ft), were exposed to a step wedge tablet with built-in filters to allow neutral, cyan, magenta and yellow images and were processed in Dev/Amps 10 to 13 over a period of hours and days. The complete process cycle used was as follows:

| | |
|---|---|
| Develop | 45 seconds |
| Stop | 30 seconds |
| Bleach-fix | 45 seconds |
| Wash | 120 seconds |
| Dry | |

where the Stop was 15 g/l sodium metabisulphite and the bleach-fix was RA4 bleach-fix.

The Dmax of these strips is given as a function of time in Table 5.

TABLE 5

| DEV No. Time | Dmax as a function of time Dmax(N) × 100 | | | | | | | | | | | |
|---|---|---|---|---|---|---|---|---|---|---|---|---|
| | 10 | | | 11 | | | 12 | | | 13 | | |
| (hrs) | R | G | B | R | G | B | R | G | B | R | G | B |
| 0 | 251 | 266 | 268 | 262 | 272 | 275 | 258 | 266 | 266 | 245 | 264 | 268 |
| 0.5 | 263 | 267 | 268 | 263 | 271 | 274 | 261 | 272 | 274 | 248 | 266 | 269 |
| 4 | 235 | 237 | 239 | 252 | 261 | 263 | 255 | 265 | 267 | 244 | 260 | 262 |
| 20 | 112 | 126 | 145 | 253 | 264 | 261 | 249 | 255 | 251 | 244 | 262 | 259 |
| 92 | 68 | 82 | 94 | 259 | 266 | 256 | 255 | 262 | 241 | 240 | 256 | 251 |
| 125 | — | — | — | 247 | 254 | 240 | 259 | 262 | 245 | 229 | 248 | 242 |
| 172 | — | — | — | 252 | 257 | 239 | 262 | 262 | 243 | 232 | 249 | 244 |

It is clear from these data that the catalytic activity of the colloidal silver is prevented by the inclusion of dodecylamine. The presence of acetic acid used to dissolve the dodecylamine in Dev/Amp 12 does not appear to have a significant effect as shown by comparison with Dev/Amp 11 which did not contain acetic acid. The higher level of dodecylamine and TWEEN™ 80 in Dev/Amp 13 does appear to result in consistency lower red Dmax.

EXAMPLE 4

In this example three Dev/Amps are compared for their standing stability and initial sensitometry in the presence of potential stabilizers against silver catalyzed decomposition but without any added silver. The Dev/Amp compositions are shown in Table 6.

TABLE 6

| Dev/Amp No. | Developer/amplifier Composition |
|---|---|
| 14 | Control as in Table 1 |
| 15 | 14 + 0.2 g/l ARMAC ™ 12D + 0.2 g/l TWEEN ™ 80 |
| 16 | 14 + 0.2 g/l ARQUAD ™ 16-50 + 0.2 g/l TWEEN ™ 80 |

The results of the standing test are shown in Table 7.

TABLE 7

| Time | Dmax (× 100) as a function of time DEV No | | | | | | | | |
|---|---|---|---|---|---|---|---|---|---|
| | 14 | | | 15 | | | 16 | | |
| (days) | R | G | B | R | G | B | R | G | B |
| 0 | 253 | 266 | 270 | 245 | 262 | 265 | 235 | 262 | 267 |
| 3 | 257 | 265 | 261 | 244 | 261 | 258 | — | — | — |
| 4 | 264 | 266 | 261 | 254 | 265 | 261 | — | — | — |
| 5 | 267 | 268 | 253 | 256 | 266 | 250 | — | — | — |
| 7 | 273 | 268 | 241 | 262 | 263 | 241 | — | — | — |
| 10 | 269 | 263 | 227 | 259 | 256 | 234 | — | — | — |

It can be seen that ARMAC™ 12D causes perhaps a small loss in Dmax. The Dev/Amp containing ARMAC™ 12D is clearly the one most similar to the control. ARQUAD™ 16–50 causes an initial drop in activity but the Dev/Amp (16) was essentially inactive after 3 days.

EXAMPLE 5 REDOX AMPLIFIER SOLUTION

This is an example of the invention and compares amplifiers 3 and 4 (the invention) with amplifiers 1 and 2 (comparative examples).

Four solutions were made up of the following composition.

TABLE 8

| Solution composition | | | | |
|---|---|---|---|---|
| | Solution Number | | | |
| Component | 1 | 2 | 3 | 4 |
| 1-Hydroxyethylidene-1,1'-diphosphonic acid (60% soln.) | 0.6 g/l | 0.6 g/l | 0.6 g/l | 0.6 g/l |
| Pentasodium diethyltriaminepentaacetic acid (40% soln) | 2.0 ml/l | 2.0 ml/l | 2.0 ml/l | 2.0 ml/l |
| $K_2HPO_4.3H_2O$ | 40 g/l | 40 g/l | 40 g/ | 40 g/l |
| KBr | 1 mg/l | 1 mg/l | 1 mg/l | 1 mg/l |
| KCl | 0.3 g/l | 0.3 g/l | 0.3 g/l | 0.3 g/l |
| pH | 11.4 | 11.4 | 11.4 | 11.4 |
| Dodecylamine | — | — | 0.1 g/l | 0.1 g/l |
| TWEEN ™ 80 | — | — | 0.4 g/l | 0.4 g/l |
| $H_2O_2$ (30%) | 2.0 ml/l | 2.0 ml/l | 2.0 ml/l | 2.0 ml/l |
| Carey Lea Silver | — | 7.3 mg/l | 7.3 mg/l | — |

The level of hydrogen peroxide was monitored over a period of time and the results are shown in Table 9. The start values at solution age 0 are in fact about 3 minutes old which is the time it takes to add the colloidal silver and then take a sample and analyze it for hydrogen peroxide.

TABLE 9

| Hydrogen Peroxide Analysis | | | | |
|---|---|---|---|---|
| | Hydrogen Peroxide Level (ml/l, 30%) | | | |
| Solution Age | 1 | 2 | 3 | 4 |
| 0 | 2.09 | 1.73 | 1.84 | 1.90 |
| 1 hr | 1.97 | 0.36 | 1.83 | 1.94 |
| 2 hrs | 2.01 | 0.20 | 1.72 | 1.93 |
| 4.3 hrs | 1.94 | 0.10 | 1.73 | 1.96 |
| 6 hrs | 1.96 | 0 | 1.74 | 1.91 |
| 7 hrs | 1.97 | 0 | 1.73 | 1.90 |
| 70 hrs | 1.91 | 0 | 1.58 | 1.84 |
| 6 days | 1.85 | 0 | 1.56 | 1.80 |
| 11 days | 1.88 | 0 | 1.42 | 1.75 |

Solution 1 is the control without any added colloidal silver and it shows about a 10% loss in 11 days. Solution 2 is the same as the control but with 7.3 mg/l of colloidal silver (Carey Lea Silver) and it has decomposed completely after about 4.5 hours. Solution 3 is the same as solution 2 except that catalytic inhibitor, dodecylamine is included. It can be seen that solution 3 is very much more stable than solution 2 with a loss of peroxide of about 30% in 11 days (assuming 2.0 ml/l at the start). This shows that dodecylamine very substantially deactivates the colloidal silver. Solution 4 is the same as solution 1 except that it contains dodecylamine (silver is absent from both 1 and 4) and is slightly less stable than the control solution 1.

The Example shows that dodecylamine stabilizes amplifier solutions containing hydrogen peroxide (but without color developing agent) against catalyzed decomposition.

The invention has been described in detail with particular reference to preferred embodiments thereof, but it will be understood that variations and modifications can be effected within the spirit and scope of the invention.

I claim:

1. A photographic processing solution comprising a redox amplification oxidant or a compound which provides a redox amplification oxidant, and dissolved in said solution, a water-insoluble compound having a hydrophobic hydrocarbon group and an additional group which adsorbs to silver or stainless steel, said solution further comprising a nonionic surfactant to solubilize said water-insoluble compound.

2. The processing solution of claim 1 in which the redox amplification oxidant is hydrogen peroxide or a compound which provides hydrogen peroxide.

3. The processing solution of claim 1 further comprising a color developing agent.

4. The processing solution of claim 1 in which the hydrophobic hydrocarbon group is an alkyl group having from 8 to 20 carbon atoms or an alkylaryl group having from 14 to 27 carbon atoms.

5. The processing solution of claim 1 in which the hydrophobic group is a branched or unbranched alkyl group having from 10 to 18 carbon atoms.

6. The processing solution of claim 1 in which the processing solution is an amplifier, a developer/amplifier or a bleach solution.

7. The processing solution of claim 1 in which the compounds having a group which adsorbs to silver are primary, secondary or tertiary long chain alkylamines, long chain alkyl quaternary ammonium salts, long chain alkyl heterocyclic ammonium salts, long chain alkyl aminocarboxylic acids, long chain alkyl aminosulphonic acids, long chain alkyl diamines, long chain alkyl branched alkyldiamines, long chain alkyl thiols, long chain alkyl thiocarboxylic acids, long chain alkyl thiosulphonic acids, long chain alkyl-substituted nitrogen-containing heterocyclic or mercapto-heterocyclic compounds in which the long chain alkyl group contains 7–20 carbon atoms.

8. The processing solution of claim 1 in which said compound having a group which adsorbs to silver is present at a concentration in the range 0.01 to 5 g/l.

9. A method for processing an imagewise-exposed silver halide photographic element comprising contacting said element with the processing solution of claim 1.

10. The processing solution of claim 1 wherein said non-ionic surfactant is a polyoxyethylene long chain ester, alcohol, or amine in which the number of polyoxyethylene groups is from 3 to 30.

11. The processing solution of claim 10 wherein said non-ionic surfactant is a polyoxyethylene ester having an alkyl group of 8–20 carbon atoms, and present at a concentration in the range 0.01 to 10 g/l.

12. The method of claim 9 wherein said photographic element is a color photographic paper.

13. The method of claim 9 wherein said photographic element is a multicolor element.

14. The method of claim 9 wherein said element is processed in a small volume tank wherein the element is passed through a thickness of processing solution of less than 11 mm.

15. The method of claim 12 wherein said color photographic paper comprises at least one emulsion comprising at least 85 mol % silver chloride.

16. The method of claim 12 wherein said photographic element has a total silver level of from 5 to 700 mg/m$^2$.

17. The method of claim 16 wherein said photographic element has a total silver level of from 10 to 120 mg/m$^2$.

18. The method of claim 17 wherein said photographic element has a total silver level of from 15 to 60 mg/m$^2$.

* * * * *